US007185575B1

(12) United States Patent
Collier et al.

(10) Patent No.: US 7,185,575 B1
(45) Date of Patent: Mar. 6, 2007

(54) WEAPON MOUNTING AND REMOTE POSITION RECOGNITION SYSTEM

(75) Inventors: Ronald F. Collier, Decatur, AL (US); John T. Dillon, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 37 days.

(21) Appl. No.: 11/251,532

(22) Filed: Oct. 4, 2005

(51) Int. Cl.
*F41F 3/04* (2006.01)

(52) U.S. Cl. ..... 89/1.8; 89/1.815

(58) Field of Classification Search ..... 89/1.8, 89/1.815, 1.816, 1.819, 1.82
See application file for complete search history.

(56) References Cited

U.S. PATENT DOCUMENTS

| | | | | | |
|---|---|---|---|---|---|
| 3,106,132 | A | * | 10/1963 | Biermann et al. | 89/1.815 |
| 3,865,009 | A | * | 2/1975 | Kongelbeck | 89/1.815 |
| 3,892,162 | A | * | 7/1975 | Phillips | 89/1.815 |
| 3,946,640 | A | * | 3/1976 | Baumann | 89/1.815 |
| 3,990,355 | A | | 11/1976 | Looger et al. | |
| 4,166,406 | A | * | 9/1979 | Maughmer | 89/1.815 |
| 4,305,325 | A | * | 12/1981 | Lange et al. | 89/1.815 |
| 4,444,086 | A | * | 4/1984 | White | 89/1.8 |
| 4,519,315 | A | | 5/1985 | Arszman | |
| 5,123,327 | A | * | 6/1992 | Alston et al. | 89/1.813 |
| 5,129,307 | A | * | 7/1992 | Cain et al. | 89/1.815 |
| 6,584,881 | B1 | * | 7/2003 | Boudreau et al. | 89/1.804 |
| 6,691,600 | B2 | * | 2/2004 | Boudreau et al. | 89/1.815 |
| 6,742,433 | B2 | * | 6/2004 | Smith et al. | 89/1.815 |

FOREIGN PATENT DOCUMENTS

| | | | |
|---|---|---|---|
| WO | WO 94/17357 | * | 8/1994 |

* cited by examiner

*Primary Examiner*—Michael J. Carone
*Assistant Examiner*—Bret Hayes
(74) *Attorney, Agent, or Firm*—Jack K Greer

(57) ABSTRACT

A system for remote tracking of a tactical missile assembly orientation during targeting and leading to launch from a platform, including a weapon station frame rotatably attached to the platform and a command launch unit attached to the weapon station frame. A launch tube assembly is pivotably attached thereon, including a launch tube in which a tactical missile is positioned prior to launch. The launch tube is replaceable with a like-configured launch tube and tactical missile. A launch tube position recognition unit is disposed proximal of the launch tube and adjacent of the weapon station frame. The position recognition unit includes a tracking and encoder device enclosed by a protective encoder member rotatably attachable between the launch tube and weapon station frame. The tracking and encoder device identifies launch tube positions and remotely relays position coordinates to the command launch unit during targeting of the missile leading to missile launch.

16 Claims, 6 Drawing Sheets

WEAPON MOUNTING AND REMOTE POSITION RECOGNITION SYSTEM

CROSS-REFERENCE TO RELATED APPLICATIONS

Not Applicable.

STATEMENT REGARDING FEDERALLY SPONSORED RESEARCH OR DEVELOPMENT

The invention described herein may be manufactured, used and licensed by or for the Government for governmental purposes without the payment to the inventors of any royalties thereon.

BACKGROUND OF THE INVENTION

1. Field of the Invention

The invention relates to devices utilized for supporting and launching tactical ground-based missiles. More specifically, the present invention relates to a mounting unit and remote position detection system for missiles mounted on a movable or stationary platform.

2. Description of the Related Art

Shoulder supported small missile launching devices are known in the art of weaponry available for infantry. A typical man-portable missile launching device is disclosed in U.S. Pat. No. 3,990,355 (the '355 patent), issued to L. L. Looger et al. The '355 patent discloses a shoulder carried anti-tank rocket launcher including a launch tube in which a rocket resides until launched, a firing sight, and folding shoulder recoil stop mechanism. The shoulder carried rocket launcher is designed to be light weight and easily aimed to facilitate rapid use on the battlefield. The shoulder carried rocket launcher requires the soldier to be positioned near the target and at least briefly unprotected during targeting and launch, therefore the soldier is vulnerable to immediate attack from enemy soldiers and/or the mechanized target.

A guidance system for a shoulder fired missile launcher is disclosed in U.S. Pat. No. 4,519,315 (the '315 patent), issued to J. H. Arszman. The guidance system is utilized with a shoulder held man-portable missile launcher. The guidance system provides target identification by a rangefinder, calculation of range and launch elevation, and firing of a missile from a shoulder carried missile launcher at a significant distance from the target. The missile proceeds along a ballistic trajectory to an aerial position above the target, with motor unit separation from the missile carrying a warhead, electronics unit and drag spoiler. The missile is guided to drop on the target by a target detection sensor associated with the warhead. The ability to fire the missile launcher a significant distance from the target, along with flight along a ballistic trajectory path to the target, provides for attack on a target by a soldier positioned a significant distance from a target during targeting, launch and transit of a missile, with reduction in vulnerability of a soldier except during operation of the missile launcher.

A soldier transport vehicle preferably includes armament mounted on an exterior of a transport vehicle sized to transport soldiers during battle. A need exists for a rotatable and pivotable mounting and position recognition system for a missile mounted on a vehicle, which allows for missile position adjustments during targeting by a soldier inside a vehicle and allows for rapid vehicle movement following launch.

BRIEF SUMMARY OF THE INVENTION

A weapon mounting and missile position recognition system is disclosed, including a weapon station frame for support of a launch tube assembly sized to hold a tactical missile capable of being remotely positioned and fired by an operator within a vehicle on which the missile is mounted. The tactical missile comprises any of a variety of small anti-tank missiles, including but not limited to a U.S. Army Javelin anti-tank missile system. The launch tube assembly (hereinafter, the launch tube or LTA) is pivotably mounted to extend laterally from the weapon station frame which is rotatably mounted at a base end to an exterior of a wheeled or tracked vehicle, such as a U.S. Army Stryker® Light Armored Vehicle or any of a variety of military vehicles and boats utilized to transport soldiers, equipment, and/or supplies. A command launch unit (hereinafter, CLU) is connected relative to the weapon station frame in an orientation substantially adjacent of the launch tube. The rotatable mounting of the weapon station frame, LTA and the CLU relative to the vehicle allows for rapid CLU adjustments in angle orientation and in rotational orientation while the CLU is tracking a target. The CLU includes multiple instruments for sighting a target and determining range to a target, including at least one visual light sighting device and at least one infrared sighting device. For optimal missile positioning and launch, the LTA should move with the CLU when pivoting and rotating relative to the vehicle.

The launch tube is pivotably positioned to move in angle orientation relative to the weapon station frame and the CLU by a mounting bracket, cradle and a tube drive arm attached between the launch tube and the weapon station frame. The angle of orientation and rotational position of the launch tube is ascertained by a position encoder positioned proximal to an inboard side of the mounting bracket and the launch tube. The mounting bracket includes an opening against which a sealed bearing unit is positioned to provide a pivoting connection between the mounting bracket, encoder cap and the position encoder to allow remote recognition of the launch tube position. The position encoder is enclosed by an encoder cap disposed inboard of the mounting bracket and sealed bearing unit. An encoder hub unit is attached between the encoder cap and a side portion of an upper frame cross-member of the weapon station frame. The mounting bracket, bearing unit, encoder cap and encoder hub unit maintain the position encoder in a protected position adjacent to the launch tube to enable remote verification of positioning of the launch tube by an occupant within the vehicle during targeting and launch. The encoder cap protects the position encoder from outside interference by environmental contaminants or light impairment, and allows the position encoder to accurately confirm and remotely convey position coordinates of the LTA to a launch computer control module associated with the CLU during targeting of the missile. The mounting bracket, bearing unit, encoder cap and position encoder also allows an operator to remain protected in a vehicle on which the weapon station frame is mounted during positioning of the launch tube leading to missile launch.

BRIEF DESCRIPIION OF THE DRAWINGS

The present invention is illustrated in the drawings in which like element numbers represent like parts in each figure, including:

DETAILED DESCRIPTION OF THE INVENTION

Figure 1:
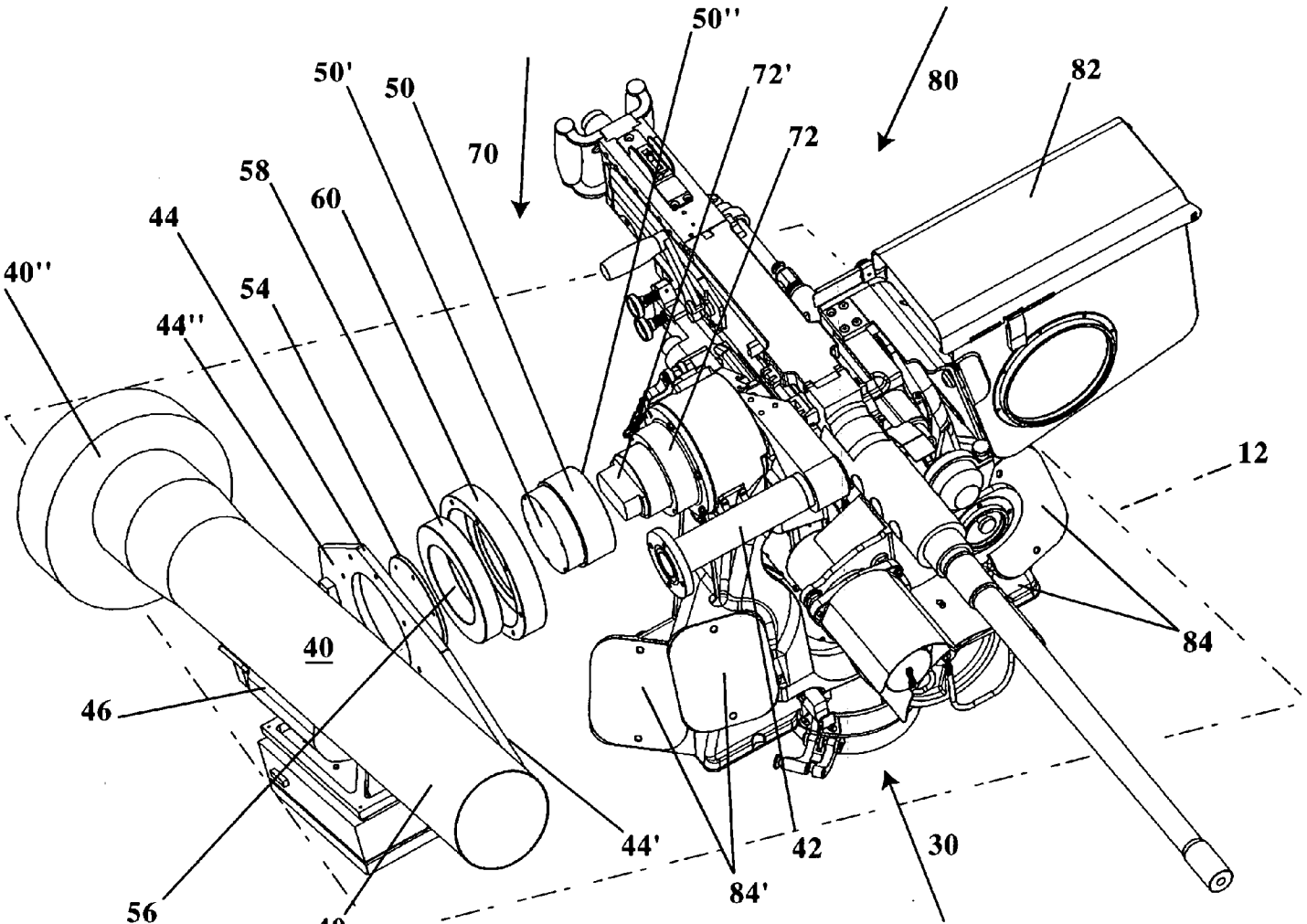
FIG. 1 is an exploded view of one embodiment of a weapon mounting and remote recognition system of the present invention mounted relative to a vehicle or a platform.

Referring now to FIGS. 1–7, a missile launch tube mounting and position recognition system 10 is illustrated which provides for accurate verification of the movements of a missile launch tube assembly (LTA) 40 such as a U.S. Army Javelin medium range anti-tank missile system. The LTA 40 is rotationally mounted on a support structure such as a stationary base or a readily assembled support structure having a command operation unit positioned nearby, or is rotationally mounted on a vehicle 12 such as a U.S. Army Stryker® Light Armored Vehicle, or alternatively mounted on a boat or a platform such as a trailer. The missile launch tube mounting and position recognition system 10 is combined with a command launch unit (CLU) 30 which tracks the target and assists in targeting by adjusting the rotational positioning and elevation orientation of the LTA 40. The CLU 30 is rotationally mounted adjacent to the LTA 40 on a stationary base, a support structure such as a trailer, a floatable structure such as a boat or barge, or on a vehicle 12. The combination of the LTA 40 and CLU 30 mounted to rotate concurrently without hands-on adjustments by a soldier, allows an operator to be protected from hostile fire by remaining in the vehicle 12 or an operation unit positioned nearby.

In one illustrated embodiment, the LTA 40 is supported by a weapon station frame 20 attachable to an outer surface of an armored vehicle 12 (see FIGS. 1–3) in an orientation allowing rotation by pivoting relative to the vehicle upper surface or side surface. The weapon station frame 20 includes a rotatable base 22 having a main or frame support bracket 24 extending therefrom. The rotatable base 22 includes a rotation mechanism which allows about a full 360° circle of rotation 22' for the weapon station frame 20. A central portion of the frame support bracket 24 includes an opening 26 therethrough for positioning of a command launch unit 30 having reconnaissance devices therein. The command launch unit 30 is composed of multiple units described as a launch electronics assembly (LEA) 32, including one or more reconnaissance devices positioned within a support bracket opening 26, and an onboard computer system contained within the vehicle 12 having sufficient interior space for the onboard computer system to be accessed by an operator. The reconnaissance devices of the launch electronics assembly 32 are positioned within or adjacent of the support bracket opening 26, and include one or more of each of the following, an optical camera 32', a rangefinder 32", and an infrared sensor 32'". The LEA 32 further includes at least one computer and associated circuitry, a visual output display, appropriate electrical connections and at least one power unit positioned within the vehicle 12 to allow operation by a sheltered soldier/occupant of the vehicle 12. Additional target sensing and distance estimating electronic units can readily be added by positioning within or adjacent of the support bracket opening 26, by attaching to the frame support bracket 24 and by connecting to the circuitry associated with the LEA 32 onboard computer system (not shown).

Figure 2:
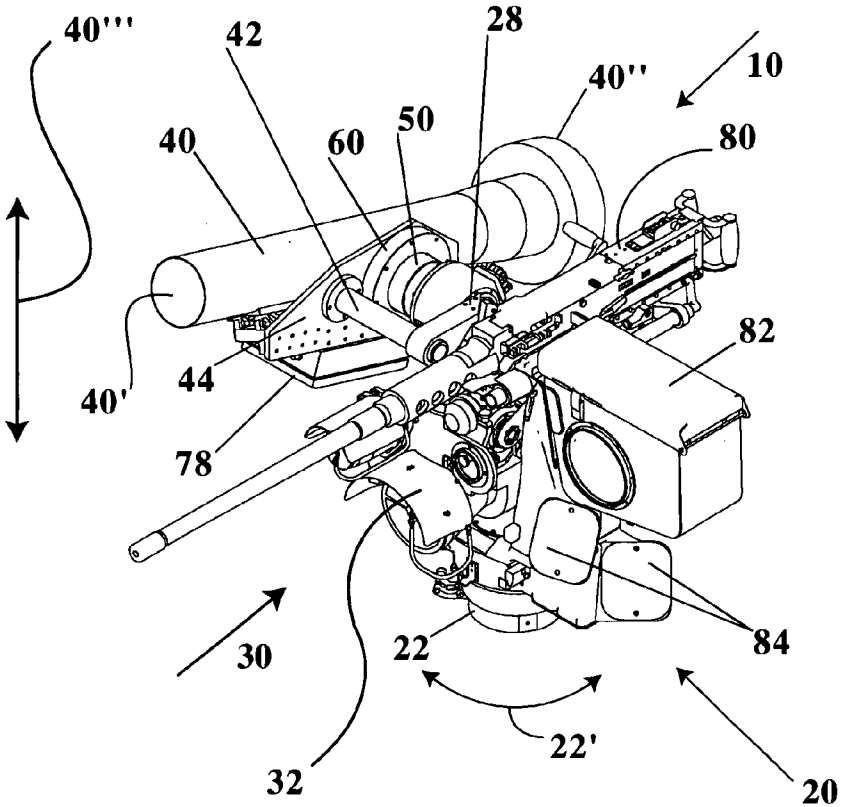
FIG. 2 is a side perspective view of the weapon station frame of FIG. 1, including a rotatable base mount, missile launch tube and position recognition unit, and multiple targeting devices.
Figure 7:
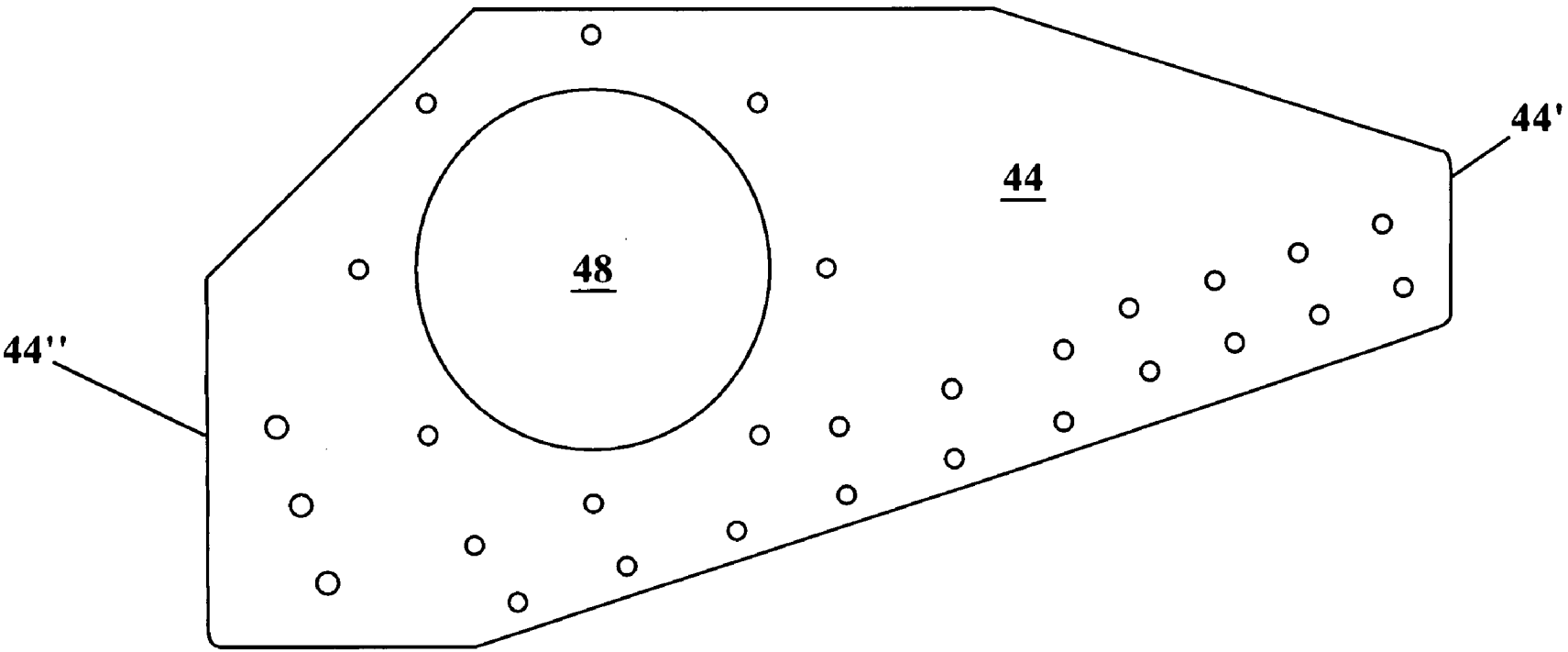
FIG. 7 is a side view of a mounting plate for positioning the encoder hub connector and position encoder cap adjacent to the missile launch tube.

The LTA 40 is supported for pivoting at a pivot axis at approximately the tube mid-segment to allow elevation changes 40'" for the missile ejection end 40' relative to the command launch unit 30 rotatably supported by the weapon station frame 20. The LTA 40 is attached to a mounting plate 44, which is pivoted by a drive arm 42 extended from a connection end 42' which extends inboard to attach at an inboard end 42" to an upper frame cross-member 28 (see FIGS. 2 and 4). As illustrated in FIGS. 2 and 7, the mounting plate 44 extends adjacent to a significant portion of the launch tube mid-segment. Spaced along the launch tube mid-segment, a cradle support 46 is positioned to releasably attach to the LTA 40 (see FIG. 3). The main cradle support 46 includes a forward tube/cradle release member 46' and a rear tube/cradle release member 46". The releasable attachment mechanism can alternately include at least one encircling bracket and/or one or more tube retaining straps (not shown) which can be utilized to assist in securing the launch tube in a position outboard of the mounting plate 44. After firing of a missile from the LTA 40, one or more encircling bracket(s) or tube retainer straps are disengaged to allow removal of the empty missile tube, and loading of a like-configured missile tube bearing another missile on the cradle support 46. The at least one encircling bracket and/or one or more tube retainer straps are re-engaged in preparation of repetition of the targeting and firing process.

Elevation changes for the LTA 40 are provided by a mechanical means attached to the drive arm 42, which extends from an inboard side of the mounting plate 44 at a position ahead of (see FIGS. 2 and 4), or behind (not shown), the pivot axis of the mounting plate 44. The drive arm 42 is driven by the mechanical means which can include an electric motor, a power source associated with the vehicle, and/or a hydraulic mechanism and power source associated with the vehicle for rotating the frame 20 relative to the vehicle 12. Elevation changes for the launch tube ejection end 40' by movement of the drive arm 42 are directed by an operator's interpretation of information relayed by launch electronics assembly 32 to the operator in the vehicle 12.

Movement of the LTA 40 is provided by the launch tube being pivotably supported by a mounting plate 44 and cradle support 46 which are moved by the drive arm 42. The mounting plate 44 includes an opening 48 at about a mid-segment and correlating with a mid-segment of the LTA 40. The opening 48 includes an adequate diameter for a sealed roller bearing ring 58 to be attached against an inboard side of the mounting plate 44. The sealed roller bearing ring 58 serves as a rotational connector unit between the mounting plate 44, the encoder hub connector 60, and the encoder cap 50 and includes a typical roller bearing assembly in the form of a ring 58 having roller bearings therein. The rotational connector unit allows the LTA 40 to pivot through a plurality of angles of orientation relative to the generally upright weapon station frame 20, and to pivot in different orientations relative to a separately pivoting weapon cradle 80 attached to an upper portion of the upper frame cross-member 28.

Remote recognition of the angle of orientation of the LTA 40 relative to the upper frame cross-member 28, the CLU 30 and the weapon station frame 20 is provided by a launch tube position recognition unit 70 (see FIG. 1), which is positioned inboard of the LTA 40 and sealed roller bearing ring 58. The position recognition unit 70 tracks and confirms launch tube positioning such as the degree of pivoting and angle of elevation of the launch tube mid-segment, thereby identifying the angle and height positions of the launch tube front end 40' and rear end 40" due to the launch tube being a cylinder having sufficient rigidity to withstand a missile launch. The position recognition unit 70 includes a launch tube tracking device such as a position encoder 72 positioned inboard of mounting plate 44 and adjacent of bearing ring 58.

Figure 4:
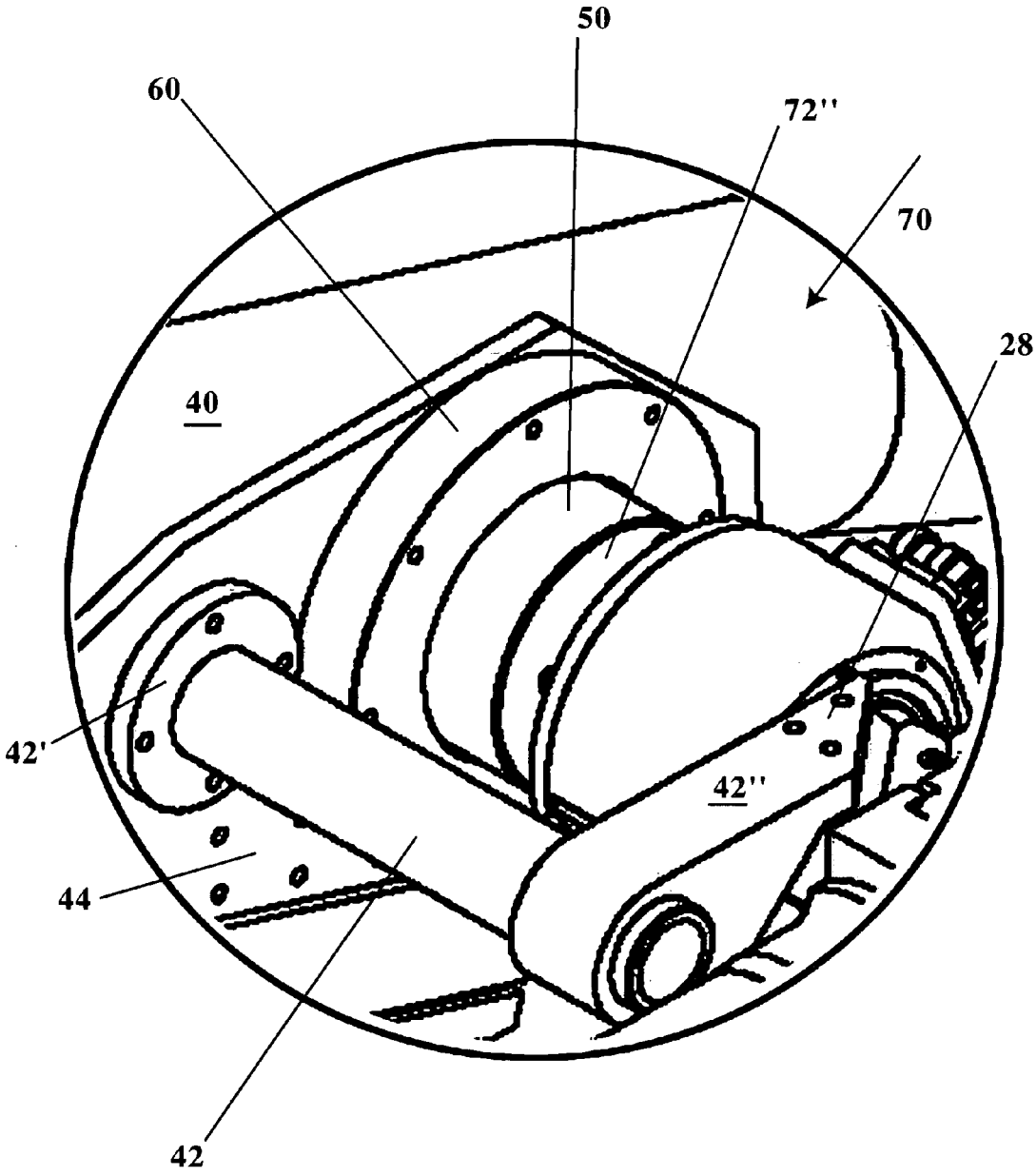
FIG. 4 is a detailed view of the launch tube position recognition unit of FIG. 2.
Figure 5B:
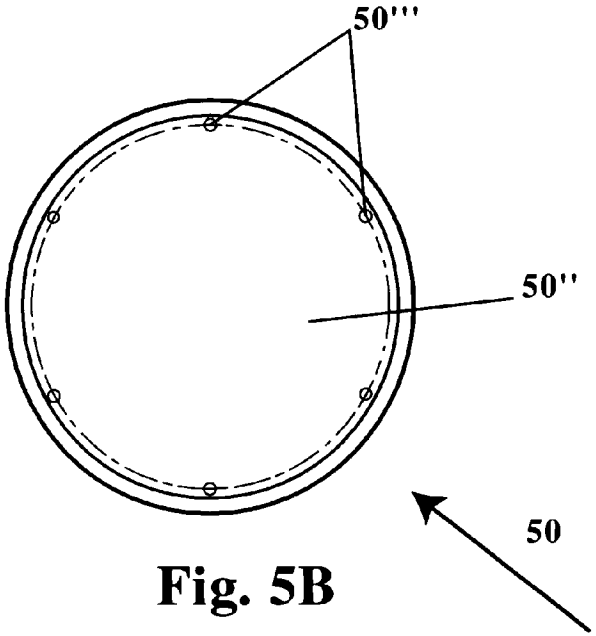
FIGS. 5A–5C are various views of a position encoder cap of FIG. 4.
Figure 5A:
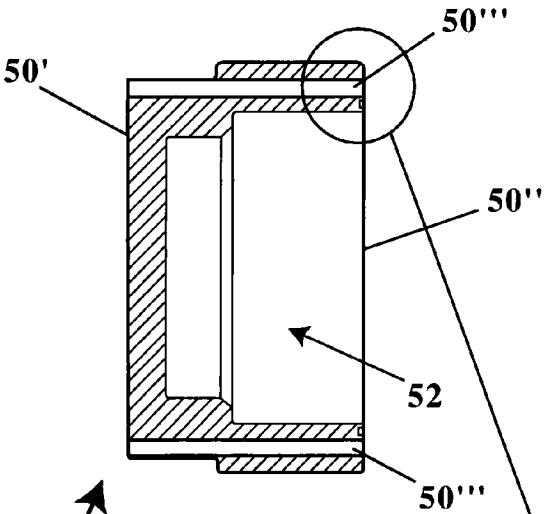
Figure 5C:
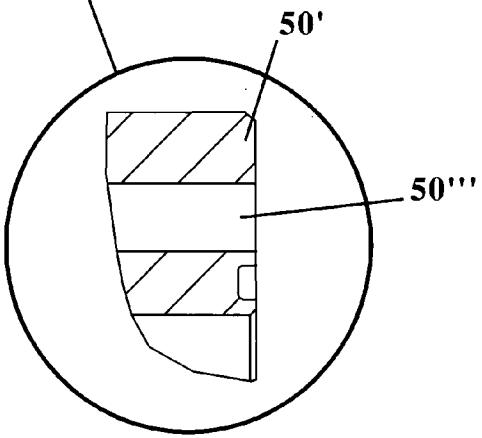
Figure 6B:
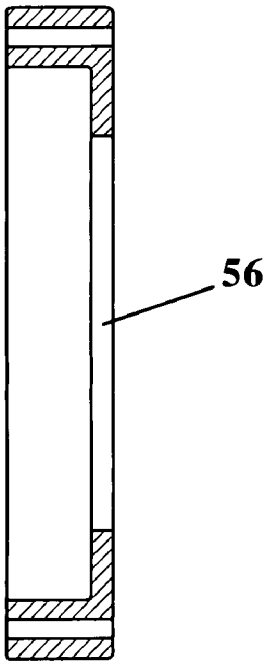
FIGS. 6A–6B are various views of an encoder hub connector to which the position encoder cap of FIGS. 5A–5C is attached.
Figure 6A:
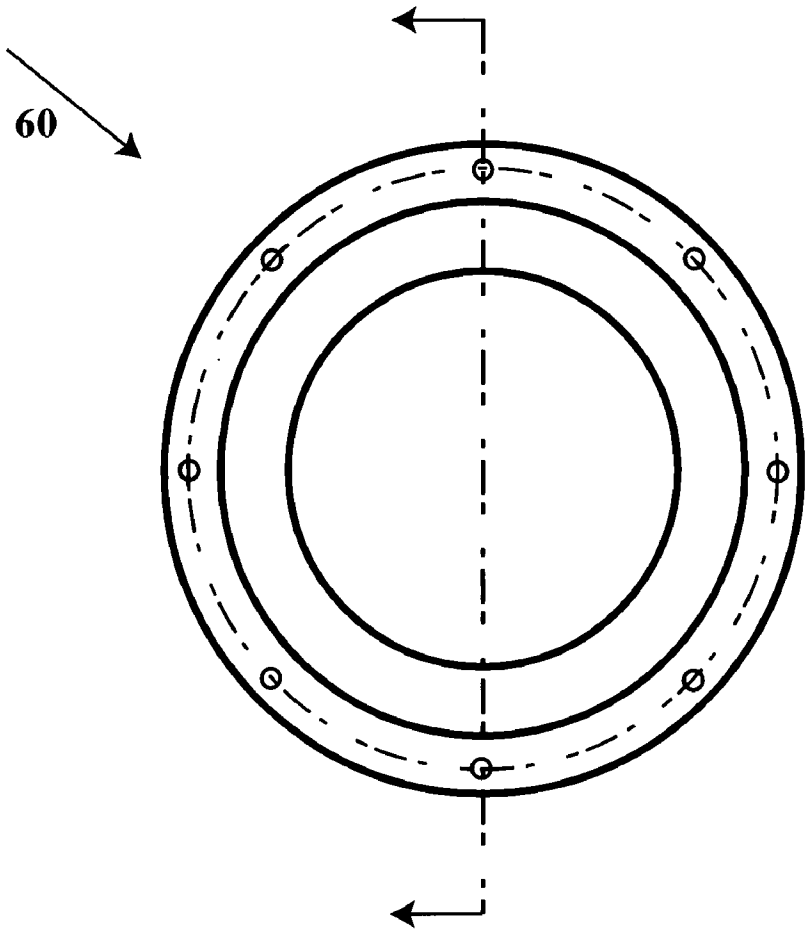

One embodiment for orientation of the position encoder 72 includes an outboard end 72' disposed within the encoder cap outboard end 50', which is positioned within the bearing ring 58 and encoder hub connector 60 connectable against the mounting plate 44 and adjacent of a mid-segment of the LTA 40 (see FIGS. 1, 2 and 4). Illustrated in FIGS. 1, 2 and 4–5C, an arcuate enclosure unit identified as an encoder cap 50 serves as a protective member by covering the position encoder 72 in a positioned adjacent to the mid-segment of the LTA 40. The encoder cap 50 hollow interior 52 and base connector end 50" provide enclosure and protection of the electronics associated with the position encoder outboard end 72' while allowing the position encoder base end 72" to remain positioned proximal of the drive arm inboard end 42" and proximal of the launch electronics assembly 32 mounted on the frame 20. Transmitter circuitry associated with the electronics of the position encoder 72 provides for transmission of signals from the encoder 72 to a computer control module 76 which an operator within the vehicle 12 is able to interface with in order to remotely confirm that the LTA 40 has acquired a proper angle of orientation prior to launch by confirming movements of the mounting plate 44 and LTA 40.

The encoder cap 50 is configured to include an interior 52 adequate to receive therein the position encoder 72 (see FIGS. 1, 5A–5C). Upon assembly of the launch tube position recognition unit 70 (see FIG. 1), an encoder cap outboard end 50' inserts through the encoder hub connector 60. An opening in the inboard end 50" is sized to readily accept therein the outboard end 72' of the position encoder 72 (see FIG. 1). The encoder cap inboard end 50" includes a circumferential grove or a plurality of holes 50'" to allow the inboard end 50" to be pressed against the position encoder base end 72" (see FIG. 1). The encoder hub 60 is positioned to encircle a portion of the encoder hub outboard end 50' when the outboard end 50' is aligned for insertion through an annular bearing unit 58 which is connected to a cover plate 54 associated with the mounting plate 44. The cover plate 54 further assists with covering a center opening 56 of a sealed roller bearing ring 58 inserted into an encoder hub connector 60 which attaches against the mounting plate 44 (see FIGS. 1, 6A, 6B and 7). The encoder cap 50 includes generally cylindrical interior surfaces (see FIGS. 5A–5C) having contours which minimize contact between the interior surfaces of the encoder cap 50 and the position encoder 72 therein, during pivoting of the mounting plate 44 relative to the upper frame cross-member 28. The mounting plate 44, encoder cap 50, sealed roller bearing ring 58 and encoder hub connector 60 maintain the position encoder 72 in a protected orientation adjacent to the LTA 40 during movements of the launch tube. The encoder cap 50 protects the position encoder 72 from outside interference by environmental contaminants or light impairment thereby allowing the position encoder 72 to accurately confirm and transmit launch tube position coordinates to a launch computer control module 78 positioned in the vehicle 12, or to transmit launch tube position coordinates to a command operation unit positioned apart from the LTA 40.

Figure 3:
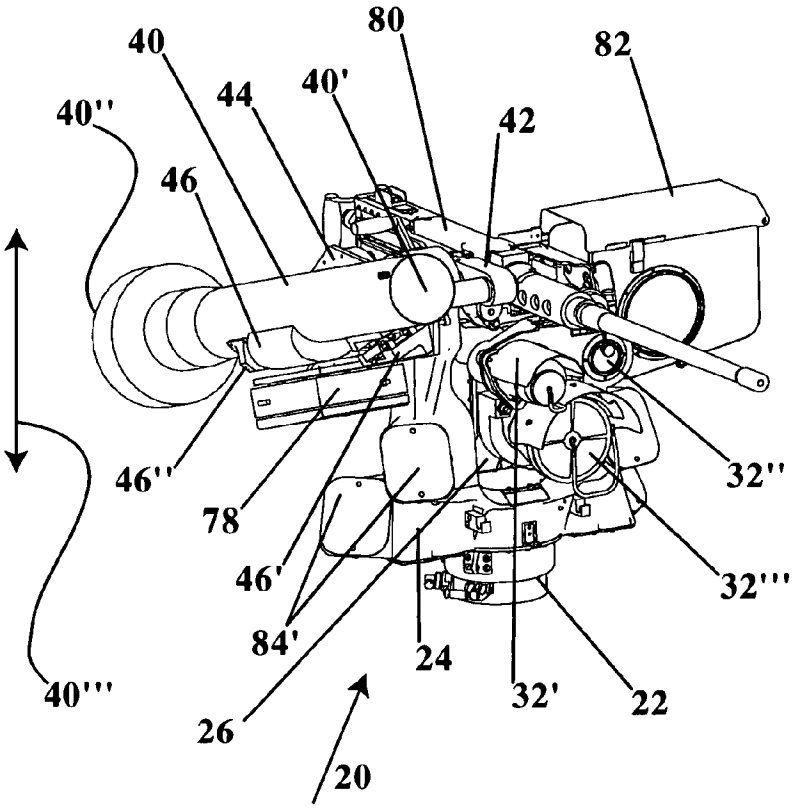
FIG. 3 is an opposite side perspective view of FIG. 2.

The sealed roller bearing ring 58 and encoder hub connector 60 allow the launcher assembly 40, 42, 44 to rotate with the weapon station frame 20 and to be repositioned 40'" in a plurality of angled elevations during targeting of the LTA 40. The encoder cap 50 maintains an enclosing orientation with the position encoder 72 during rapid repositioning of the LTA 40 during tracking and targeting of a moving target by the launch computer control module 78 and the launch electronics assembly 32 associated with the CLU 30. As illustrated in FIGS. 2 and 3, the angles of elevation 40'" of the LTA 40 are adjusted similar to the angles of positioning of the additional armament 80 mounted on the weapon station frame 20. The side-to-side rotation of the additional armament 80 and the LTA 40 are moved in unison by the weapon station frame 20 in order to avoid interference between firing cycles of the armament 80 and the targeting and firing cycles of the LTA 40. Further, the angle of elevation 40'" of the LTA 40 is adjustable independent of the set positioning of the pairs of port covers 84, 84' which cover grenade launch mechanisms (not shown). The launch tube front end 40' can be elevated in anticipation of launch of one or more grenades from the port covers 84, 84' to avoid interference by the LTA 40 with the release of grenades from the weapon station frame 20. Therefore, the continuous monitoring and detection of an angle of elevation 40'" of the LTA 40 by the position encoder 72 is crucial to proper targeting and launch of a tactical missile from each launch tube attached to the mounting bracket cradle 46, and is also important to negate interference between the multiple weapon systems 40, 80, 84, 84' mounted on the weapon station frame 20.

While numerous embodiments and methods of use for this invention are illustrated and disclosed herein, it will be recognized that various modifications and embodiments of the invention may be employed without departing from the spirit and scope of the invention as set forth in the appended claims. Further, the disclosed invention is intended to cover all modifications and alternate methods falling within the spirit and scope of the invention as set forth in the appended claims.

What is claimed is:

1. A system for remote tracking of a tactical missile assembly orientation during targeting by an operator prior to launch from a stationary or mobile platform, comprising:

a weapon station frame rotatably attached to a platform;

a command launch unit movably attached to said weapon station frame;

a launch tube assembly pivotably attached to said weapon station frame, said launch tube assembly including a launch tube having a first missile therein and a tube support bracket having a release mechanism disposed to retain said launch tube during launch of the first missile, said launch tube is removed upon manipulation of said release mechanism allowing replacement of said launch tube with a like-configured launch tube preloaded with a second missile therein; and a launch tube position recognition unit pivotably disposed proximal of said launch tube assembly, said launch tube position recognition unit including a launch tube tracking device protected by an arcuate enclosure unit and further including a rotational ring connector against which said arcuate enclosure unit and launch tube tracking device are positioned adjacent of said launch tube;

whereby said launch tube position recognition unit identifies launch tube position coordinates and relays the launch tube position coordinates to said command launch unit during rotation of said weapon station frame and pivoting of said launch tube assembly leading to said launch tube and missile being positioned for launch.

2. The system of claim 1 wherein said weapon station frame including:

a base rotatably attachable to said platform and providing for rotation of said weapon station frame relative to said platform in about 360 degrees of rotation;

a frame support bracket extended upwards from said base, said frame support bracket configured to support said command launch unit on said frame support bracket, and to support said launch tube position recognition unit and said launch tube assembly in positions laterally adjacent of said command launch unit;

an upper frame cross-member extended from said frame support bracket; and a drive arm extending from said upper frame cross-member, said drive arm having an outboard end attached to said tube support bracket, and having an inboard end attached to a mechanical means for movement of said drive arm in an upward or downward orientation;

whereby said drive arm is manipulated in the upward or downward orientation by said mechanical means controlled by the operator with resultant pivoting of said launch tube in a plurality of angled orientations.

3. The system of claim 2 wherein said launch tube assembly including:

said launch tube having a missile ejection end and a mid-segment supported by said tube support bracket, said mid-segment being pivoted by said drive arm with resultant elevation or lowering of said missile ejection end;

said tube support bracket including a cradle on which said launch tube is releasably supported, whereby said launch tube is removable after missile launch and a replacement launch tube having an additional tactical missile therein is releasably positioned on said tube support bracket cradle; and a mounting plate attached inboard of said tube support bracket cradle, said mounting plate having a central opening therein and having an inboard surface to which said drive arm outboard end is releasably attached, whereby said mounting plate, tube support bracket cradle and launch tube are adjustable through a range of angled orientations by said drive arm at the direction of said operator interfaced with said command launch unit.

4. The system of claim 3 wherein said command launch unit including:

a launch electronics assembly disposed in a protected area associated with the platform;

a plurality of reconnaissance devices including optical and infrared sensors, said reconnaissance devices are pivotably attached to said rotatable weapon station frame;

an onboard computer system disposed in the protected area associated with the platform; and a power unit associated with the platform, said power unit interconnected with each of said launch electronics assembly, plurality of reconnaissance devices, onboard computer system, weapon station frame, launch tube position recognition unit and launch tube assembly.

5. The system of claim 3 wherein said launch tube position recognition unit including:

a position encoder disposed proximal of an inboard side of said mounting plate;

said arcuate enclosure unit is rotatably attached to said inboard side of said mounting plate by said rotational ring connector connected to said mounting plate inboard surface, said arcuate enclosure unit being rotatable in alignment with said central opening while providing protection for said position encoder enclosed; and said rotational ring connector includes a sealed roller bearing disposed within a hub connector to which said arcuate enclosure is releasably attached.

6. The system of claim 4 wherein said platform including an armored vehicle having an enclosed area of sufficient interior space for said onboard computer system to be accessed by an operator.

7. The missile mounting and tracking unit of claim 1 wherein the platform including an amphibious vehicle.

8. A missile launch system for tracking movements of a tactical missile launch assembly during targeting adjustments leading to launch, comprising:

a weapon station frame rotatably attached to a platform;

a command launch unit movably attached to said weapon station frame;

a launch tube assembly pivotably attached to said weapon station frame, said launch tube assembly including:

a launch tube having a first missile therein;

a tube support bracket extended from said weapon station frame; and a tube support bracket having a release mechanism positioned to retain said launch tube during launch of the first missile, said launch tube is removable by manipulation of said release mechanism allowing replacement of said launch tube with a like-configured launch tube pre-loaded with a second missile; and a launch tube position recognition unit pivotably disposed proximal of said launch tube assembly, said launch tube position recognition unit including:

a launch tube tracking device aligned adjacent and inboard of said launch tube assembly;

an arcuate enclosure unit disposed to contain said launch tube tracking device, said arcuate enclosure unit is rotatably attached inboard of said launch tube, said arcuate enclosure unit being pivotable with said launch tube; and a rotational ring connector against which said arcuate enclosure unit and launch tube tracking device are positioned adjacently inboard of said launch tube;

whereby said launch tube position recognition unit identifies launch tube position coordinates and relays the coordinates to said command launch unit during rotation of said weapon station frame and pivoting of said launch tube assembly leading to said launch tube and missile being positioned for launch.

9. The missile launch system of claim 8 wherein said launch tube assembly including:

said launch tube having a missile ejection end and a mid-segment supported by said tube support bracket, said mid-segment being pivoted by said drive arm with resultant elevation or lowering of said missile ejection end;

said tube support bracket including a cradle on which said launch tube is releasably supported, whereby said launch tube is removable after missile launch and a replacement launch tube having an additional tactical missile therein is releasably positioned on said tube support bracket cradle; and a mounting plate attached inboard of said tube support bracket cradle, said mounting plate having a central opening therein and having an inboard surface to which said drive arm outboard end is releasably attached, whereby said mounting plate, tube support bracket cradle and launch tube are adjustable through a range of angled orientations by said drive arm at the direction of said operator interfaced with said command launch unit.

10. The missile launch system of claim 8 wherein said command launch unit including:

a launch electronics assembly disposed in a protected area associated with the platform;

a plurality of reconnaissance devices including optical and infrared sensors, said reconnaissance devices are pivotably attached to said rotatable weapon station frame;

an onboard computer system disposed in the protected area associated with the platform; and a power unit associated with the platform, said power unit interconnected with each of said launch electronics assembly, plurality of reconnaissance devices, onboard computer system, weapon station frame, launch tube position recognition unit and launch tube assembly.

11. The missile launch system of claim 8 wherein said weapon station frame including:

a base rotatably attachable to said platform and providing for rotation of said weapon station frame relative to said platform in about 360 degrees of rotation;

a frame support bracket extended upwards from said base, said frame support bracket configured to support said command launch unit on said frame support bracket, and to support said launch tube position recognition unit and said launch tube assembly in positions laterally adjacent of said command launch unit;

an upper frame cross-member extended from said frame support bracket; and a drive arm extending from said upper frame cross-member, said drive arm having an outboard end attached to said tube support bracket, and having an inboard end attached to a mechanical means for movement of said drive arm in an upward or downward orientation;

whereby said drive arm is manipulated in the upward or downward orientation by said mechanical means controlled by the operator with resultant pivoting of said launch tube in a plurality of angled orientations.

12. A missile mounting and tracking unit positioned on a platform, comprising:

a weapon station frame rotatably attached to a platform;

a command launch unit movably attached to said weapon station frame;

a launch tube assembly pivotably attached to said weapon station frame, said launch tube assembly including a launch tube having a first missile therein and a tube support bracket having a release mechanism disposed to retain said launch tube during launch of the first missile, said launch tube is removed upon manipulation of said release mechanism allowing replacement of said launch tube with a like-configured launch tube preloaded with a second missile therein; and a launch tube position tracking device extended from said weapon station frame and disposed proximal of said launch tube assembly, said launch tube position tracking device being sensitive to movements of said launch tube;

an arcuate enclosure unit having an inboard open end positioned to enclose without binding to said launch tube position tracking device, said arcuate enclosure unit having an outboard end attached to a rotational ring connector attachable inboard of said launch tube, whereby said arcuate enclosure unit is pivotable in unison with said launch tube while said launch tube position tracking device remains extended from said weapon station frame;

whereby said launch tube position recognition unit identifies launch tube position coordinates and relays the launch tube position coordinates to said command launch unit during rotation of said weapon station frame and pivoting of said launch tube assembly leading to said launch tube and missile being positioned for launch.

13. The missile mounting and tracking unit of claim 12 wherein said weapon station frame including:

a base rotatably attachable to said platform and providing for rotation of said weapon station frame relative to said platform in about 360 degrees of rotation;

a frame support bracket extended upwards from said base, said frame support bracket configured to support said command launch unit on said frame support bracket, and to support said launch tube position recognition unit and said launch tube assembly in positions laterally adjacent of said command launch unit;

an upper frame cross-member extended from said frame support bracket; and a drive arm extending from said upper frame cross-member, said drive arm having an outboard end attached to said tube support bracket, and having an inboard end attached to a mechanical means for movement of said drive arm in an upward or downward orientation;

whereby said drive arm is manipulated in the upward or downward orientation by said mechanical means controlled by the operator with resultant pivoting of said launch tube in a plurality of angled orientations.

14. The missile mounting and tracking unit of claim 12 wherein said launch tube assembly including:

said launch tube having a missile ejection end and a mid-segment supported by said tube support bracket, said mid-segment being pivoted by said drive arm with resultant elevation or lowering of said missile ejection end;

said tube support bracket including a cradle on which said launch tube is releasably supported, whereby said launch tube is removable after missile launch and a replacement launch tube having an additional tactical missile therein is releasably positioned on said tube support bracket cradle; and a mounting plate attached inboard of said tube support bracket cradle, said mounting plate having a central opening therein and having an inboard surface to which said drive arm outboard end is releasably attached, whereby said mounting plate, tube support bracket cradle and launch tube are adjustable through a range of angled orientations by said drive arm at the direction of said operator interfaced with said command launch unit.

15. The missile mounting and tracking unit of claim 12 wherein said command launch unit including:

a launch electronics assembly disposed in a protected area associated with the platform;

a plurality of reconnaissance devices including optical and infrared sensors, said reconnaissance devices are pivotably attached to said rotatable weapon station frame;

an onboard computer system disposed in the protected area associated with the platform; and a power unit associated with the platform, said power unit interconnected with each of said launch electronics assembly, plurality of reconnaissance devices, onboard computer system, weapon station frame, launch tube position recognition unit and launch tube assembly.

16. The missile mounting and tracking unit of claim 12 wherein the platform including an armored land vehicle.

* * * * *